United States Patent [19]

Norton

[11] Patent Number: 4,561,823

[45] Date of Patent: Dec. 31, 1985

[54] WHEELCHAIR TIPPING APPARATUS

[75] Inventor: Harry W. Norton, Ludlow, England

[73] Assignee: Hatrick Industries Limited, Shrewsbury, England

[21] Appl. No.: 564,704

[22] Filed: Dec. 23, 1983

[30] Foreign Application Priority Data

Dec. 24, 1982 [GB] United Kingdom ..... 8236752

[51] Int. Cl.[4] ..... A61G 5/00; A61G 7/10

[52] U.S. Cl. ..... 414/678; 269/68; 280/43.24; 280/47.2; 280/641; 297/DIG. 4; 414/921

[58] Field of Search ..... 414/678, 680, 921; 280/43.24, 47.2, 641; 269/17, 68, 72; 297/DIG. 4

[56] References Cited

U.S. PATENT DOCUMENTS

| | | | |
|---|---|---|---|
| 2,234,358 | 3/1941 | Schray | 280/641 |
| 2,397,317 | 3/1946 | Hulburt et al. | 280/641 |
| 3,191,990 | 6/1965 | Rugg et al. | 297/DIG. 4 |
| 3,198,575 | 8/1965 | Hawkins | 297/DIG. 4 |
| 3,476,404 | 11/1969 | Rachman | 297/DIG. 4 |
| 3,733,689 | 5/1973 | Armitage | 269/17 X |
| 4,010,499 | 3/1977 | 297 | DIG. 4/ |
| 4,096,955 | 6/1978 | Dake | 414/921 X |
| 4,192,549 | 3/1980 | Petersen | 297/DIG. 4 |

FOREIGN PATENT DOCUMENTS

| | | |
|---|---|---|
| 7029447 | 8/1970 | Fed. Rep. of Germany . |
| 3131504 | 2/1983 | Fed. Rep. of Germany . |
| 2140053 | 1/1973 | France . |
| 2029334 | 3/1980 | United Kingdom . |

*Primary Examiner*—Leslie J. Paperner

*Attorney, Agent, or Firm*—Staas & Halsey

[57] ABSTRACT

A carriage for receiving a wheelchair is pivotable relative to a frame between a lowered position (as shown) wherein the wheelchair can be wheeled onto and off the carriage, and a raised position (FIG. 3) wherein the wheelchair is tipped in a vertical plane. The carriage is raised and lowered by an operating mechanism which is fully operated by the wheelchair occupant and which includes hand grips positioned to either side of the carriage. A fluid damper prevents the carriage from being lowered except at a controlled relatively slow rate.

46 Claims, 9 Drawing Figures

WHEELCHAIR TIPPING APPARATUS

BACKGROUND OF THE INVENTION

This invention relates to wheelchair tipping apparatus.

There has been proposed apparatus for tipping wheelchairs, which comprises a frame having mounted thereon a carriage adapted to receive a wheelchair in use. The carriage can be turned relative to the frame between a lowered position wherein the wheelchair can be wheeled onto and off the carriage and a raised position wherein the wheelchair is tipped in a vertical plane. Operating means is operable to raise and lower the carriage relative to the frame.

In this proposal, the operating means takes the form of a member which extends rearwardly from the frame and which must be manually pushed in order to raise the carriage. The member has a series of abutments which can be selectively engaged with a fixed part of the frame, thereby to hold the carriage in one of a number of tipped positions. Although the apparatus has found considerable utility in enabling wheelchair occupants to be tipped rearwardly into a reclining or semi-reclining position (for example ready for examination by a doctor or a dentist) without requiring the occupant to leave the wheelchair, it nevertheless suffers from a number of disadvantages. Firstly, the nature of the operating means makes it necessary for a person other than the wheelchair occupant to push the aforesaid member in order to raise the carriage: it would be a considerable advantage if the wheelchair occupant himself or herself could tip the carriage. Secondly, when the carriage is in its lowered position, the member projects quite a considerable distance behind the frame, and is therefore liable to cause an obstruction. Thirdly, there is a danger that, when the carriage is in a raised position, the abutment on the member may accidentally become dislodged from the fixed frame part, allowing the carriage to fall freely under gravity. This may result in possible injury of the wheelchair occupant.

SUMMARY OF THE INVENTION

It is an object of the present invention to overcome these disadvantages.

According to one aspect of the invention, in apparatus of the above-described general type the operating means is disposed so that it can be operated by an occupant of the wheelchair when the latter is received by the carriage.

According to a second aspect of the invention, in apparatus of the above-described general type, the operating means includes a device which does not permit the carriage to be lowered relative to the frame except at a controlled rate.

BRIEF DESCRIPTION OF THE DRAWINGS

The invention will now be further described, by way of example only, with reference to the accompanying drawings, in which.

DESCRIPTION OF THE PREFERRED EMBODIMENT

Figure 1:
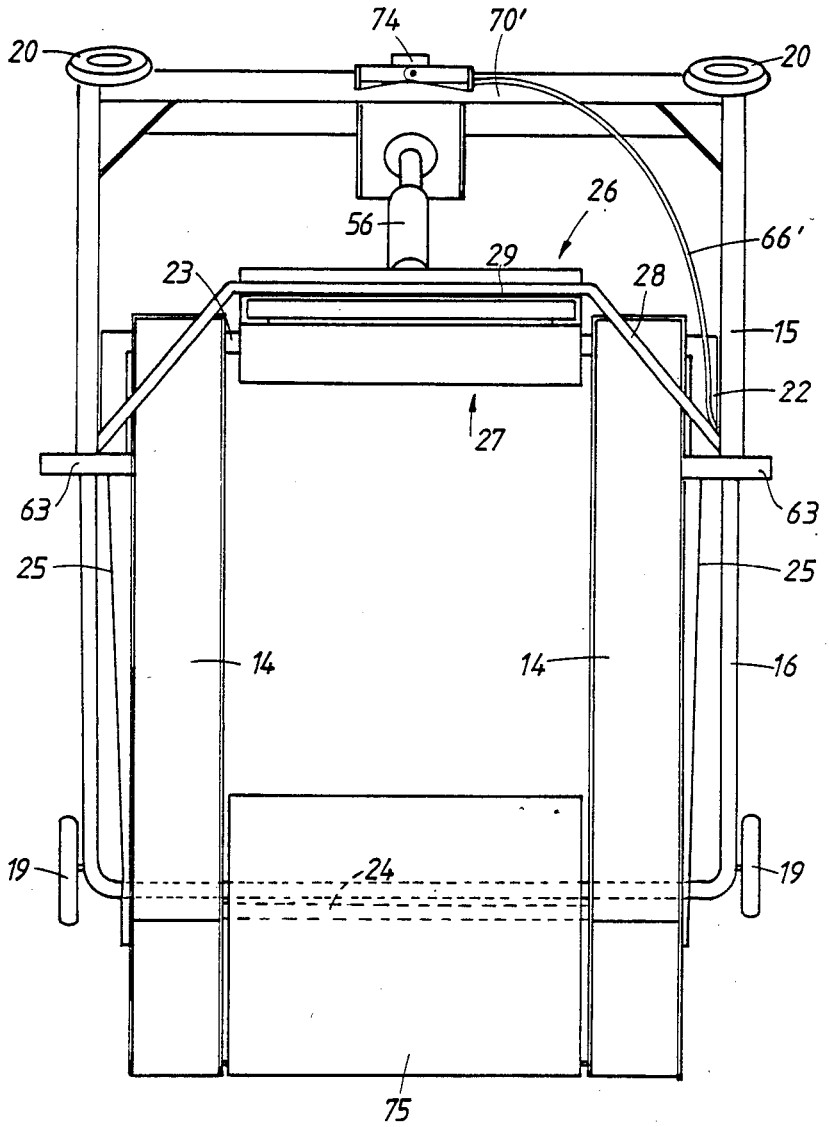
FIG. 1 is a plan view of wheelchair tipping apparatus according to the present invention.
Figure 2:
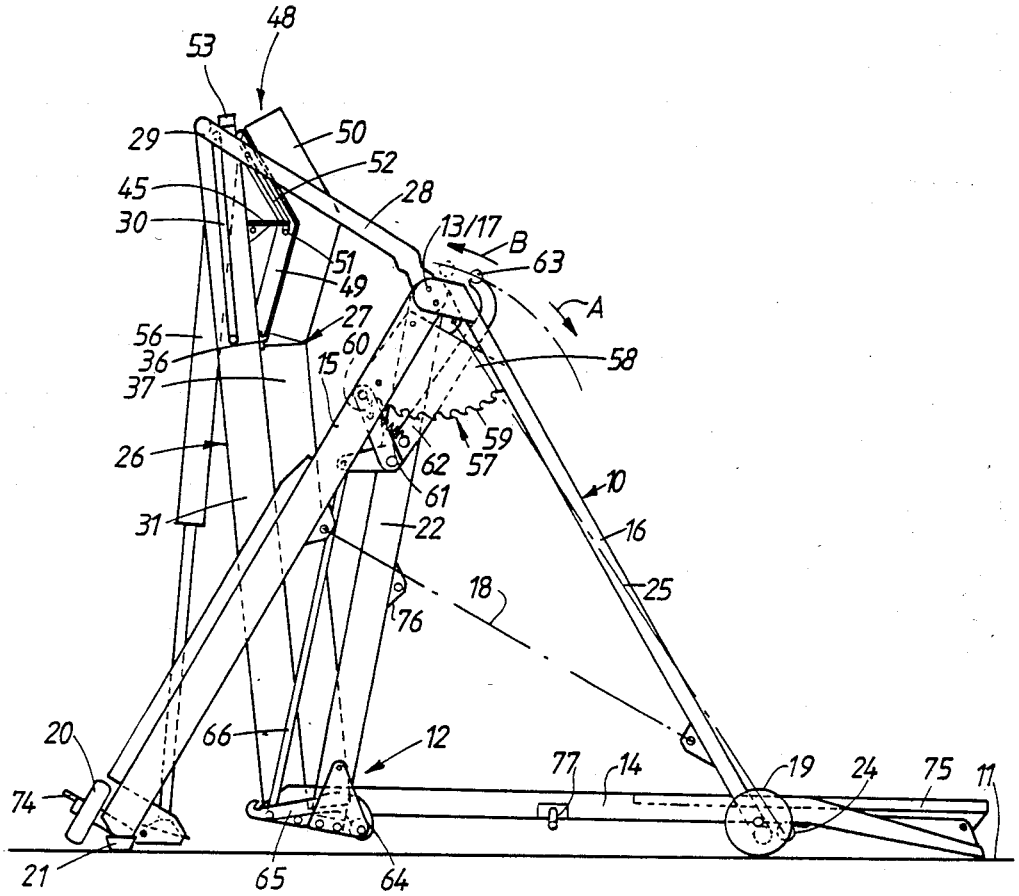
FIG. 2 is a side view of the apparatus, showing a carriage thereof in a lowered position.
Figure 3:
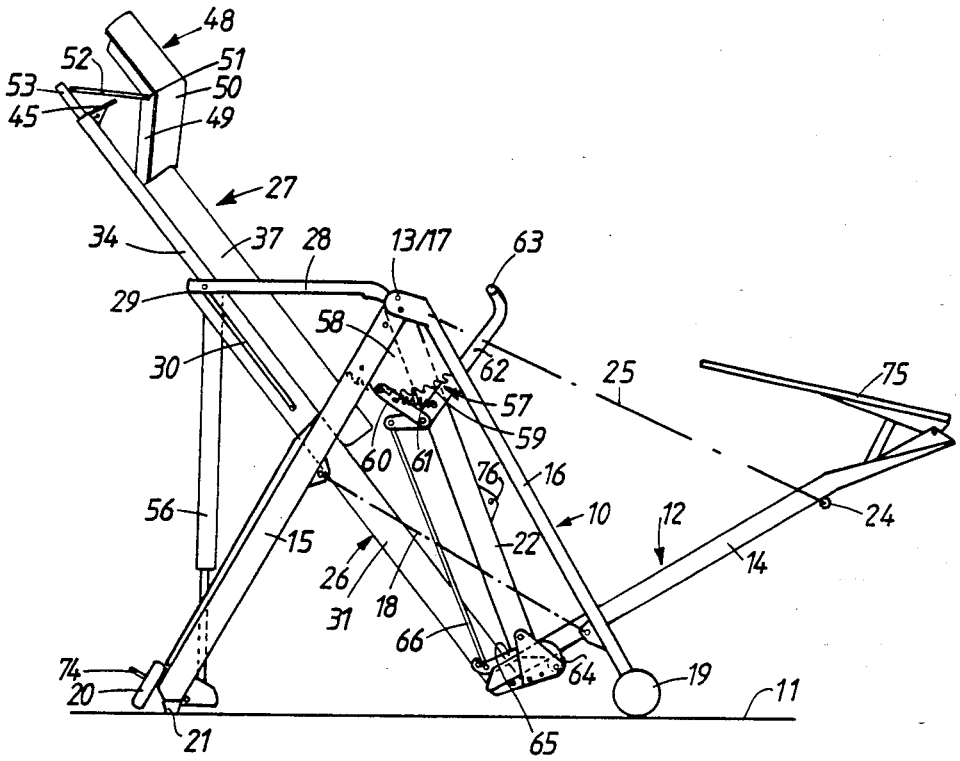
FIG. 3 is a similar view to FIG. 2 but showing the carriage in a raised position.

Referring first to FIGS. 1 to 3, the illustrated apparatus comprises generally a frame 10 which in use rests upon the ground or a similar supporting surface 11, and a carriage 12 which is mounted on the frame 10 for pivotal movement relative thereto about an axis 13. The carriage 12 can be pivoted between a lowered position (FIG. 2) wherein a wheelchair can be wheeled onto and off a pair of spaced ramps 14, and a raised position wherein the wheelchair is tipped rearwardly in a vertical plane (see FIG. 3).

The frame 10 is composed of two generally U-shaped members 15 and 16 which are interconnected at their free ends for pivotal movement about an axis 17 which is substantially coincident with the pivot axis 13. The rearward member 15 forms the main load-bearing part of the frame and is therefore made more massive than the forward member 16, which acts mainly as a prop. Chains 18 (one on each side of the frame) link the two members 15, 16 and are held under tension to prevent the members from splaying apart. A ground-engaging portion of the member 16 is provided with two wheels 19 which are rotatable about axes parallel to the pivot axes 13 and 17, while a corresponding portion of the member 15 is provided with two wheels 20 which are rotatable about axes perpendicular to the pivot axes 13, 17. In the erected condition of the frame 10, the wheels 20 are held out of contact with the ground 11, the member 15 instead engaging the ground by means of resilient friction pads 21 which hold the apparatus against rolling movement.

The carriage 12 is composed of a main U-shaped member 22 which is pivoted to the frame 10, the member having a cross-piece 23 (see FIG. 1) which is spaced from the pivot axis 13. The aforementioned ramps 14 are pivoted to the cross-piece 23 at their rear ends, and are interconnected by a cross-bar 24 near their front ends so that both ramps 14 can pivot together relative to the member 22. Chains 25 (one on either side of the carriage) link the ramps 14 to the member 22, and are held under tension to maintain the ramps normally at a fixed angular orientation to the member 22.

Also pivoted to the cross-piece 23 is a backrest unit comprising a sub-frame 26 which carries a back-and headrest assembly 27 in vertically adjustable fashion. Rearward pivotal movement of the sub-frame 26 is limited by a cranked frame member 28 whose ends are pivotally coupled to the member 22 about the axis 13 or 17 and whose central portion rests against an angle-section cross-piece 29 provided on the sub-frame 26. A pair of links 30 are pivotally connected between the frame member 28 and the sub-frame 26 respectively on either side of the latter. In the operative condition of the apparatus, the links 30 are unstressed and so they may be made of relatively light construction.

Figure 4:
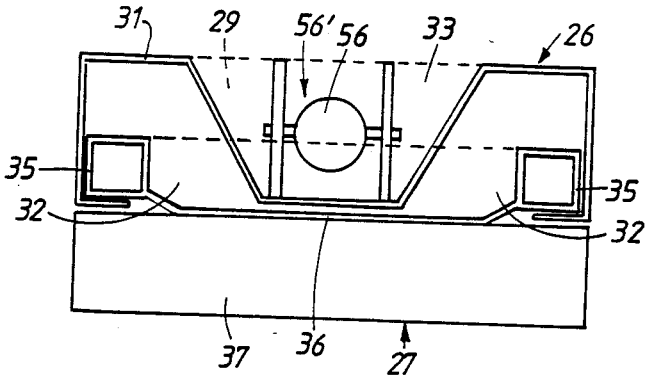
FIG. 4 is a sectional plan view of part of the carriage.

Referring now also to FIG. 4, the sub-frame 26 is composed of a metal pressing 31 which is generally M-shaped in cross-section and which defines a pair of forwardly-facing recesses 32 at its sides and a rearwardly-facing recess 33 at its middle. The above-mentioned cross-piece 29 extends across the upper end of the pressing 31, while a plate 34 extends across the lower end thereof. The back- and headrest assembly 27 includes a support comprising a pair of hollow uprights 35 which are slidably received in the recesses 32 respectively and which are interconnected by various cross-pieces 36, and a backrest cushion 37 which is carried by the cross-pieces 36.

Figure 5:
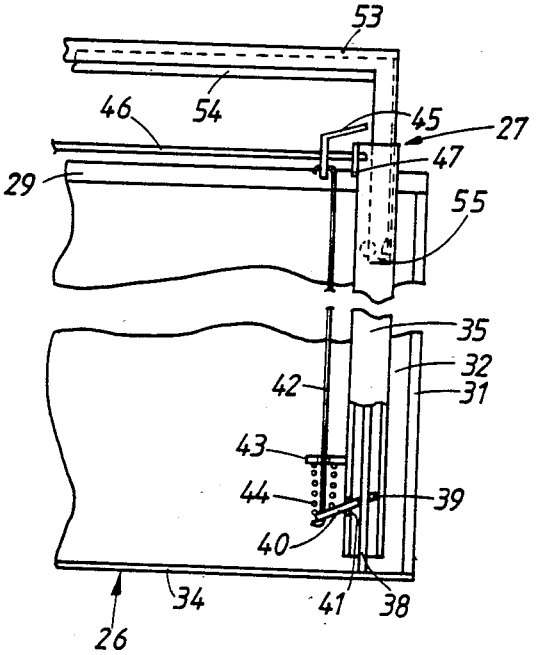
FIG. 5 is a sectional rear view of part of the carriage.

A mechanism for adjusting the vertical position of the back- and headrest assembly 27 relative to the sub-frame 26 is shown in detail in FIG. 5: in fact, only those components of this mechanism associated with one of the uprights 35 are illustrated, although it will be understood that similar components are provided for the other upright also. Each of the uprights 35 is disposed around a vertical rod 38 which is secured at its lower end to the plate 34. The rod 38 passes through a clearance hole 39 in a tiltable plate 40 which is received through a clearance slot 41 in the upright 35. The plate 40 is loosely attached to a lower end of a pull rod 42 which extends parallel to the upright 35 and passes slidably through a hole in a bracket 43 provided on the exterior of the upright. A spring 44 surrounds the pull rod 42 between the plate 40 and the bracket 43, and urges the plate 40 into a tilted position as shown. At its upper end, the pull rod 42 is pivotally attached to a thumb-lever 45 which, along with a similar lever associated with the other upright 35, is secured to a cross-rod 46. The rod 46 is rotatably supported by brackets 47 (only one shown) which are mounted on the upper ends of the uprights 35 respectively.

Under normal conditions, each plate 40 is urged by its respective spring 44 into the aforesaid tilted position, wherein the sides of the clearance hole 39 frictionally jam against the rod 38: such jamming prevents the upright 35 from being moved vertically relative to the rod 38. This jamming action can however be released simply by pressing on one or the other of the thumb-levers 45, thereby causing the pull rod 42 to move the plate 40 into a generally horizontal disposition wherein there is clearance between the rod 38 and the sides of the hole 39. The whole back- and headrest assembly 27 can then be adjusted upwardly and downwardly relative to the sub-frame 26 as desired. As soon as the thumb-lever 45 is released, the spring 44 urges the plate 40 back into its tilted position and the jamming action resumes, so that the assembly 27 is held firmly in its newly adjusted position.

Referring back to FIGS. 1 to 3, a headrest 48 is pivoted to one of the aforementioned cross-pieces 36 at an upper end of the backrest cushion 37, and comprises a pair of support members 49 (only one shown) which have a headrest cushion 50 attached thereto. In the members 49 there are formed holes 51 through which a cranked rod 52 rotatably passes. The ends of the rod 52 are rotatably mounted on an inverted U-shaped member 53 whose limbs are slidably received in the upper ends of the uprights 35, respectively. A further inverted U-shaped member 54 (see FIG. 5) is nested within the member 53 and also has its limbs slidably received by the uprights. Jamming roller mechanisms 55 (only one shown) are provided on the limbs of the members 53, 54 and within the uprights 35, and permit the members 53, 54 either to be locked relative to the sub-frame 26 or released so that they may be telescoped in unison into or out of the uprights 35, thereby adjusting the position of the headrest 48 by way of the cranked rod 52. Locking and releasing of the mechanisms 55 is achieved by moving the two members 53, 54 relative to one another in a vertical direction. More particularly, the members are normally biassed slightly apart to lock the mechanisms 55: however, upon moving the members towards each other by squeezing together their cross-pieces, the mechanisms 55 become released.

The U-shaped member 54 is designed to abut against the upper end of the sub-frame 26 when the back- and headrest assembly 27 is in its lowermost adjusted position and the headrest 48 lies back against the uprights 35, as depicted in FIG. 2. (As will be explained later, the assembly 27 and the headrest 48 occupy these positions for storage of the apparatus). If the assembly 27 should be moved into this position while the headrest 48 is extended from the uprights 35 (for example as illustrated in FIG. 3), then the member 54 will engage the cross-piece 29 prematurely. This in turn will cause the member 54 to move towards the member 53 and thereby release the jamming roller mechanisms 55, so that upon continued downward movement of the assembly 27 the headrest 48 will automatically be moved into its storage position.

Raising and lowering of the carriage 12 relative to the frame 10 is performed by means of an operating mechanism which includes a fluid damper 56 connected between a pivotal coupling 56' (see FIG. 4) on the sub-frame 26 and the rearward U-shaped member 15 of the frame 10. The damper 56 is in an extended condition when the carriage 12 occupies its lowered position, and is compressed as the carriage is raised. The design of the damper 56 is such that it can compress freely but cannot expand unless an actuator is first operated, expansion then taking place at a controlled and relatively low rate. A suitable example of a device for use as the fluid damper 56 is described in our U.K. Patent Application No. 2 134 213A. The disclosure of which is incorporated herein by reference.

The aforesaid operating mechanism also includes a pair of ratchet devices 57 disposed one on either side of the carriage 12. Each ratchet device 57 is composed of a generally sector-shaped arcuate plate 58 secured to the member 15 of the frame 10 and having ratchet teeth 59, and a ratchet pawl 60 which is engageable with the teeth 59 under the bias of a spring 61. The pawl 60 is pivotally mounted on a lever 62 which is in turn pivotally supported by the carriage 12, the lever 62 having a hand grip 63 at its upper end. Thus, two such hand grips 63 are provided, one on either side of the carriage 12, for gripping by a wheelchair occupant's left or right hand, respectively. The levers 62 of the two ratchet devices 57 are mechanically coupled together such that they operate in unison, and also to ensure that tipping loads are shared equally between the two devices 57. More particularly, a torque tube 64 extends transversely of the carriage 12 beneath the ramps 14, and has a crank arm 65 fixed to each end. Each crank arm 65 is coupled to a respective one of the levers 62 by means of a connecting rod 66, the latter being pivoted at its ends to these two parts, respectively.

Figure 6:
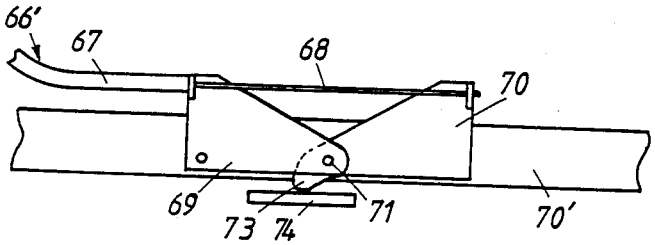
FIG. 6 is a rear view of part of the apparatus.

The levers 62 and hand grips 63 normally occupy a neutral position, as shown in FIG. 2. Movement of the levers 62 from this position in a clockwise direction effects raising of the carriage 12 relative to the frame 10 in a manner to be explained later. On the other hand, movement from the neutral position in an anticlockwise direction is arranged to operate the aforementioned actuator of the fluid damper 56. More particularly, one of the levers 62 is connected to an end of a Bowden cable 66' or the like. As shown in FIG. 6, at its other end the Bowden cable 66' has an outer sheath 67 and an inner flexible member 68 thereof connected respectively to a pair of oppositely arranged, generally triangular plates 69 and 70. The plate 69 is fixed to a cross-piece 70' of the rearward U-shaped member 15 of the frame 10, while the plate 70 is pivotable relative to the cross-piece 70' about a pin 71. The plate 70 has a rounded extension 73 which bears against one end of a lever pedal 74 which is also pivotally mounted on the cross-piece 70', the other end of this lever being engaged with the actuator of the fluid damper 56. Anti-clockwise movement of the levers 62 from their neutral position causes the flexible member 68 to retract into the sheath 67 at the end of the Bowden cable shown in FIG. 7, thereby turning the plate 70 so that its extension 73 moves the lever pedal 74 to operate the said actuator.

From the above description, it will be manifest that, whilst permitting free raising of the carriage 12 relative to the frame 10, the fluid damper 56 normally will not permit the carriage 12 to be lowered. However, lowering of the carriage 12 can occur (at a controlled rate) once the levers 62 have been moved anti-clockwise from their neutral position so as to operate the actuator of the damper 56.

In operation, the apparatus works as follows. Initially, the carriage 12 is placed in its lowered position (FIG. 2) so that the wheelchair and its occupant can be wheeled onto the ramps 14, with the back of the wheelchair then resting against the backrest unit 28. The brakes on the wheelchair are then locked. In order to raise the carriage 12 (i.e. to tip the wheelchair backwards), the wheelchair occupant grasps one or both of the hand grips 63 and moves these from the neutral position in the direction of arrow A (i.e. forwardly), thereby applying a clockwise turning force to the levers 62. At this time, the ratchet pawls 60 bear against the ratchet teeth 59 on the plates 58, such that the reaction from the turning force causes the carriage 12 to pivot relative to the frame 10 in an anitclockwise direction as viewed in FIG. 2. This in turn causes the fluid damper 56 to compress, it having been explained previously that such compression is freely permitted.

Upon return movement of the hand grips 63 to their neutral position, the levers 62 turn in an anticlockwise direction to pull each pawl 60 over the associated ratchet teeth 59, so that the pawl 60 moves along the respective plate 58 into engagement with a different one of the teeth 59. At this time, the fluid damper 56 locks the carriage 12 against downward movement relative to the frame 10 so that, notwithstanding the fact that the ratchet devices 57 are temporarily disengaged, the carriage will remain in its partially raised position. The above sequence of operations is then repeated, each time progressively tipping the carriage 12 further relative to the frame 10. In FIG. 3 the ratchet devices 57 are shown in a position before the levers 62 are returned to their neutral position.

If the carriage 12 is to be tipped by a person other than the wheelchair occupant, then it is merely necessary for that person to pull the backrest assembly 27 rearwardly and downwardly. The fluid damper 56 will freely permit such tipping, and will of course subsequently automatically lock the carriage against any downward movement. Lowering of the carriage 12 can subsequently be effected by the person pressing downwardly on the pedal 74 with his or her foot, thereby releasing the fluid damper 56.

In order to lower the carriage 12 relative to the frame 10, it is necessary simply to move the hand grips 63 from the neutral position in the direction of arrow B in FIG. 2 (i.e. rearwardly of the apparatus). This action serves not only to disengage the ratchet devices 57, but also to operate the actuator of the fluid damper 56 in the manner explained previously. The carriage 12 is therefore allowed to descend under gravity at a controlled rate. The carriage 12 can be arrested at any part of its descent simply by moving the hand grips 63 back to the neutral position.

As indicated above, the hand grips 63 are positioned so that they can readily be operated by an occupant of the wheelchair when the latter is in position on the ramps 14 of the carriage 12. Moreover, raising and lowering of the carriage can easily be performed even if the wheelchair occupant lacks the use of one arm or hand, since the hand grips 63 are provided on both sides of the carriage.

In a modification (not shown) of the above-described apparatus, the ratchet devices 57 are omitted and raising of the carriage 12 is instead performed by a fluid motor connected to the damper 31. In this way, powered operation of the apparatus can be achieved. Whether provided with such a motor or not, the damper 56 is preferably supplied as a "sealed for life" unit and is coupled to the frame 10 and the carriage 12 in such a manner that it can readily be detached for replacement.

Reference numeral 75 denotes a foot rest which may be provided between the ramps 14. This rest not only functions to support the wheelchair occupant's feet when the carriage is in a partially raised condition, but also can be pivoted through an angle of up to 90° to provide a calf support for the wheelchair occupant's legs when the carriage is near its maximum elevated condition, as indicated in FIG. 3

Figure 7:
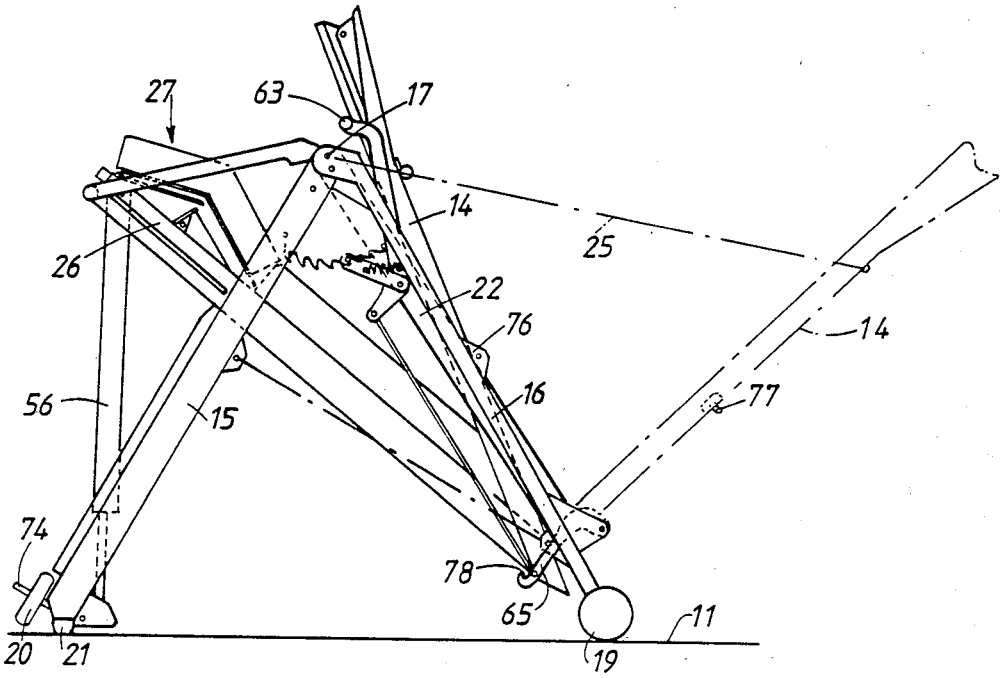
FIGS. 7, 8 and 9 are side views of the apparatus showing successive stages in an operation for folding the apparatus for storage.
Figure 8:
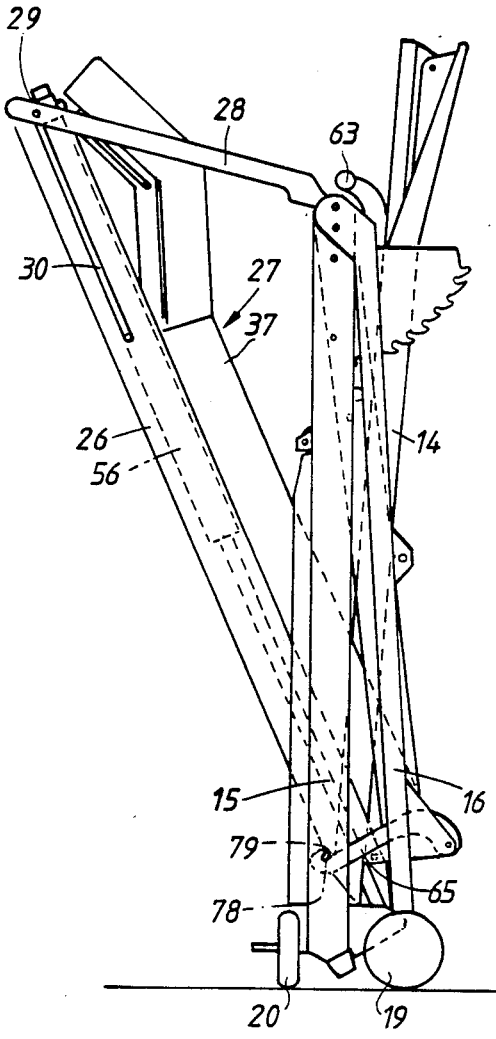
Figure 9:
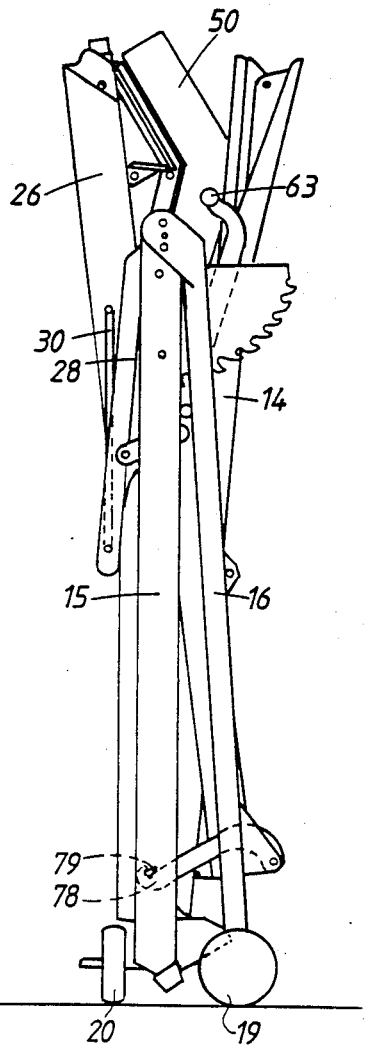

The above described apparatus is so constructed that it can be folded for transportation and/or storage by a sequence of operations as depicted in FIGS. 7, 8 and 9. Moreover, as will now be explained, such folding (and also subsequent unfolding to place the apparatus in an erected state) can easily be performed by the wheelchair occupant himself or herself.

After having lowered the back- and headrest assembly 27 (if necessary), the carriage 12 is swung into a position wherein apertured lugs 76 thereon lie just forwardly of the member 16 of the frame 10, such swinging movement of course being freely permitted by the fluid damper 56. Then, as indicated in FIG. 7, the ramps 14 are pivotally raised relative to the member 22 until they lie between the limbs of the latter, whereupon detented sliding bolts 77 (only one shown) provided on the underside of the ramps are extended so they engage through the aforesaid apertured lugs 76. When extended, the bolts 77 project laterally from the member 22 sufficiently far that their ends are positioned in front of the member 16. Thus, the bolts 77 serve not only to hold the ramps 14 in their raised position but also to retain the carriage 12 in its swung position relative to the frame 10. The apparatus is now in the condition illustrated in FIG. 7.

To continue the folding operation, it is necessary to operate the actuator of the fluid damper 56 to permit the latter to expand, this being achieved either by pulling rearwardly on the hand grips 63 or by depressing the pedal 74. By grasping the sub-frame 26 or the back- and headrest assembly 27 and pulling this both upwardly and rearwardly, the rearward U-shaped member 15 of the frame 10 is then caused to turn about the ground-engaging pads 21 to bring the wheels 20 into contact with the ground 11. At the same time, the forward U-shaped member 16 along with the folded parts of the carriage 13 will pivot rearwardly about the axis 17, with the wheels 19 on the member 16 rolling along the ground during this action. When the members 15 and 16 become juxtaposed with one another, the hand grips 63 are moved forwardly so as to pivot the crank arms 65 until latches 78 provided on the end of the latter engage respective pegs 79 provided on the member 16. The apparatus is now in the condition depicted in FIG. 8. At this point, the fluid damper 56 is at its maximum extension and lies substantially in the plane of the sub-frame 26, being accommodated within the recess 33 in the pressing 31 (see FIG. 5).

To complete folding of the apparatus, the backrest unit is pushed forwardly so that it pivots relative to the cross-piece 23. At the same time, the cranked frame member 28 is disengaged from the cross-piece 29 of the sub-frame 26 and is pivoted as far downwardly as it will go. The geometry of the member 28 and the links 30 which connect it to the sub-frame 26 is such that an overcentre action results, so that the member 28 when fully lowered holds the backrest unit firmly against the remainder of the apparatus (as shown in FIG. 9), with the backrest cushion 37 and the headrest cushion 50 being accommodated between the ramps 14.

If the folded apparatus is tipped slightly forwardly to lift the wheels 20, then it will be possible to wheel the apparatus along the ground by means of the wheels 19. Similarly, by tipping the apparatus slightly rearwardly to lift the wheels 19, the apparatus can be wheeled in a perpendicular direction by means of the wheels 20. Such slight tipping of the apparatus can readily be performed by a wheelchair occupant, so that he or she may easily manoeuvre the folded apparatus to a desired location.

In order to return the apparatus to an erected condition, the cranked frame member 28 is first lifted to permit the backrest unit to return to the position shown in FIG. 8. The hand grips 63 are then pulled rearwardly to disengage the latches 78 from the pegs 79, whereupon the frame members 15 and 16 will splay apart under the weight of the apparatus itself. Such splaying movement will of course be limited by the chains 18 which interconnect the members 15 and 16. Neither of these operations will be obstructed by the fluid damper 56, since the latter will be freely compressed at this time. The sliding bolts 77 can then be disengaged from the frame member 16 and the apertured lugs 76, thereby permitting the ramps 14 to be lowered. After the actuator of the damper 56 has been operated to permit the latter to expand, the carriage 12 can be moved into its lowered position.

It will be manifest that all of the above-described actions for folding and unfolding the apparatus can be performed extremely easily by a wheelchair occupant. From the above description, it will be apparent that the present apparatus is fully operable by a wheelchair occupant. Moreover, it is designed so that the region of the backrest unit is comparatively free from obstruction by other parts of the apparatus when the carriage 12 is in its fully raised position, so that a doctor or a dentist (for example) can gain unimpeded access to the wheelchair occupant for examination and/or treatment. Furthermore, because of the provision of the fluid damper 56, it is not possible for the carriage 12 to fall suddenly from a raised position, whether accidentally or otherwise: the damper 56 will always control the rate of descent of the carriage 12 to a safe level.

In the above-described apparatus, a wheelchair occupant must push the hand grips 63 away from himself or herself in order to raise the carriage 12. However, some paraplegic persons are incapable of pushing, although they can pull. To adapt the apparatus for such persons, the levers 62 can be re-positioned so that they extend to the rear of the apparatus. The wheelchair occupant can then reach downwardly to grasp the hand grips 63, so that a pulling action will now turn the levers 62 in such a manner as to raise the carriage 12.

When the apparatus is to be used by a doctor or dentist for treating a wheelchair occupant, it is desirable that the carriage 12 after tipping should be capable of being locked not only against lowering but also against further raising movement. Also, raising and lowering of the carriage should be out of the control of the wheelchair occupant, being instead solely controllable by the doctor or dentist. These objectives can readily be obtained by a simple modification of the apparatus, whereby the ratchet plates 59 are reversed from their illustrated positions and the pawls 60 are locked to the levers 62 rather than being pivotable relative thereto. It is also necessary to disconnect the Bowden cable which operatively couples the levers 62 to the actuator of the fluid damper 56.

In order to raise the carriage 12, the doctor or dentist now pushes on the sub-frame 26 to tip the wheelchair and its occupant to the required degree. It will be remembered that the fluid damper 56 locks the carriage 12 against lowering movement at this time. The doctor or dentist then moves the hand grips 63 in the direction of arrow A in FIG. 2 to bring the pawls 60 into engagement with the teeth 59 on the ratchet plates 58, thereby locking the carriage 12 against raising movement also. When it is subsequently desired to lower the carriage 12, the doctor or dentist then presses on the pedal 74 to operate the actuator of the damper 56, so that the carriage descends at a controlled rate with the pawls 60 riding freely over the ratchet teeth 59.

Where the present apparatus is to be used in a hospital, it is not necessary for a folding capability to be provided. It is important however that the carriage 12 should be able to receive many different types of wheelchair, including those having three wheels. Accordingly, the ramps 14 may be replaced by a filled-in floor for this purpose. The apparatus should also be constructed so that it is fully mobile with the wheelchair and occupant in situ on the carriage 12: this can readily be accomplished by suitably re-arranging the wheels 19 and 20.

I claim:

1. An apparatus for tipping wheelchairs, comprising:

a frame;

a carriage mounted on said frame and adapted to receive a wheelchair;

means enabling said carriage to be turned relative to said frame between a lowered position wherein the wheelchair can be wheeled onto and off said carriage and a raised position wherein the wheelchair is tipped in a vertical plane; and operating means operable to raise and lower said carriage relative to said frame, said operating means including a device operative to prevent said carriage from being lowered relative to said frame except at a controlled rate, said frame being composed of a plurality of frame parts which are normally spaced apart about a first pivot axis, said carriage being composed of a plurality of carriage parts which are normally spaced apart about a second pivot axis parallel to said first pivot axis, and said frame parts and said carriage parts being foldable about said first and second pivot axes respectively into positions wherein said parts lie generally side-by-side with one another.

2. An apparatus according to claim 1, wherein said frame includes two frame parts, each said frame part having a ground-engaging region and wheels provided on said ground-engaging region, said wheels on one of said frame parts being rotatable about axes parallel to said first pivot axis, said wheels on the other of said frame parts being rotatable about axes generally perpendicular to said first pivot axis.

3. An apparatus according to claim 2, wherein said wheels on said other of said frame parts are out of contact with the ground when said frame parts are angularly spaced apart about said first pivot axis.

4. An apparatus according to claim 3, wherein at least one friction pad is provided on said ground-engaging region of said other of said frame parts, said at least one friction pad being engaged with the ground when said frame parts are angularly spaced apart about said first pivot axis and being out of contact with the ground when said frame parts are folded.

5. An apparatus according to claim 3, wherein said frame parts are interconnected by at least one flexible element, said at least one flexible element being held under tension when said frame parts are angularly spaced apart about said first pivot axis.

6. An apparatus according to claim 1, wherein said carriage is raised and lowered relative to said frame by pivotal movement about a third pivot axis, said third pivot axis being substantially coincident with said first pivot axis.

7. An apparatus according to claim 1, wherein said carriage comprises a generally U-shaped frame member having a pair of limbs, a backrest unit, and a ramp unit, said ramp unit including a pair of ramps spaced apart in a direction parallel to said second pivot axis and on which the wheelchair is received, and when said carriage parts are folded the ramp unit lies between the limbs of the generally U-shaped frame member and said backrest unit lies between said ramps of said ramp unit.

8. An apparatus according to claim 7, wherein said generally U-shaped member has apertures, further comprising sliding bolts provided on said ramp unit, said sliding bolts being engageable through the apertures when said ramp unit and said generally U-shaped frame member are folded about said second pivot axis.

9. An apparatus according to claim 8, wherein said sliding bolts when engaged through the apertures project laterally from said carriage and engage said frame.

10. An apparatus according to claim 7, further comprising retaining means to limit folding movement of said backrest unit about said second pivot axis.

11. An apparatus according to claim 10, wherein said retaining means comprises a cranked member having a pair of opposite ends and a central portion disposed between said ends, said ends being pivotally mounted on said frame and said central portion providing an abutment for said backrest unit.

12. An apparatus according to claim 11, wherein said retaining means further comprises at least one link coupling said cranked member to said backrest unit, said at least one link cooperating with said cranked member to define an overcenter mechanism whereby said cranked member can be folded flat against said backrest unit.

13. An apparatus according to claim 1, wherein said carriage includes a sub-frame, a backrest and headrest assembly mounted on said sub-frame, and adjustment means enabling up-and-down adjustment of said backrest and headrest assembly relative to said sub-frame, the backrest and headrest assembly including a support comprising a hollow upright slidably received in a recess in the sub-frame.

14. An apparatus according to claim 1, wherein said carriage includes a headrest and a support on which the headrest is pivoted, there being provided adjustment means enabling said headrest to be adjusted forwardly and rearwardly of said carriage, said adjustment means including an adjustment member which can be moved up and down relative to said support, and at least one cranked element connected between said adjustment member and said headrest.

15. An apparatus for tipping wheelchairs, comprising:

a frame;

a carriage mounted on said frame and adapted to receive a wheelchair;

means enabling said carriage to be turned relative to the frame between a lowered position wherein the wheelchair can be wheeled onto and off said carriage and a raised position wherein the wheelchair is tipped in a vertical plane; and operating means operable to raise and lower said carriage relative to said frame, said operating means being disposed so that it can be operated by an occupant of the wheelchair when the wheelchair is received by said carriage, said frame being composed of a plurality of frame parts which are normally spaced apart about a first pivot axis, and said carriage being composed of a plurality of carriage parts which are normally spaced apart about a second pivot axis parallel to said first pivot axis, and said frame parts and said carriage parts being foldable about said first and second pivot axes, respectively, into positions wherein said parts lie generally side-by-side with one another.

16. An apparatus according to claim 15, wherein said frame includes two frame parts, each said frame part having a ground-engaging region, said wheels on one of said frame parts being rotatable about axes parallel to said first pivot axis, said wheels on the other of said frame parts being rotatable about axes generally perpendicular to said first pivot axis.

17. An apparatus according to claim 16, wherein said wheels on said other of said frame parts are out of contact with the ground when said frame parts are angularly spaced apart about said first pivot axis.

18. An apparatus according to claim 17, wherein at least one friction pad is provided on said ground-engaging region of said other of said frame parts, said at least one friction pad being engaged with the ground when said frame parts are angularly spaced apart about said first pivot axis and being out of contact with the ground when said frame parts are folded.

19. An apparatus according to claim 17, wherein said frame parts are interconnected by at least one flexible element, said at least one flexible element being held under tension when said frame parts are angularly spaced apart about said first pivot axis.

20. An apparatus according to claim 15, wherein said carriage is raised and lowered relative to said frame by pivotal movement about a third pivot axis, said third pivot axis being substantially coincident with said first pivot axis.

21. An apparatus according to claim 15, wherein said carriage comprises a generally U-shaped frame member having a pair of limbs, a backrest unit, and a ramp unit, said ramp unit including a pair of ramps spaced apart in a direction parallel to said second pivot axis and on which the wheelchair is received, and when said carriage parts are folded the ramp unit lies between the limbs of the generally U-shaped frame member and said backrest unit lies between said ramps of said ramp unit.

22. An apparatus according to claim 21, wherein said generally U-shaped frame member has apertures, further comprising sliding bolts provided on said ramp unit, said sliding bolts being engageable through the apertures when said ramp unit and said generally U-shaped frame member are folded about said second pivot axis.

23. An apparatus according to claim 22, wherein said sliding bolts when engaged through the apertures project laterally from said carriage and engage said frame.

24. An apparatus according to claim 21, further comprising retaining means to limit folding movement of said backrest unit about said second pivot axis.

25. An apparatus according to claim 24, wherein said retaining means comprises a cranked member having a pair of opposite ends and a central portion disposed between said ends, said ends being pivotally mounted on said frame and said central portion providing an abutment for said backrest unit.

26. An apparatus according to claim 25, wherein said retaining means further comprises at least one link coupling said cranked member to said backrest unit, said at least one link cooperating with said cranked member to define an overcenter mechanism whereby said cranked member can be folded flat against said backrest unit.

27. An apparatus according to claim 15, wherein said carriage includes a sub-frame, a backrest and headrest assembly mounted on said sub-frame, and adjustment means enabling up-and-down adjustment of said backrest and headrest assembly relative to said sub-frame, the backrest and headrest assembly including a support comprising a hollow upright slidably received in a recess in the sub-frame.

28. An apparatus according to claim 27, wherein said adjustment means comprises an upright rod mounted in said hollow upright, and a lever carried by said backrest and headrest assembly, said lever having therein a clearance hole through which said upright rod passes, said lever being movable between a first position wherein sides of the clearance hole jam against said upright rod thereby locking the backrest and headrest assembly against adjustment relative to said sub-frame, and a second position wherein the sides of the clearance hole do not jam against said upright rod thereby enabling said backrest and headrest assembly to be adjusted relative to said sub-frame.

29. An apparatus according to claim 28, wherein said adjustment means comprises two of said upright rods provided at opposite sides of said sub-frame and two of said levers engaged with said rods respectively, and said levers are coupled together for movement in unison between said first and second positions.

30. An apparatus according to claim 28, wherein said hollow upright has a clearance slot therein through which said lever extends.

31. An apparatus according to claim 28, wherein said adjustment means further comprises an operating member disposed adjacent to an upper end of said sub-frame, and a pull-rod operatively connecting said operating member to said lever, whereby said lever can be moved between said first and second positions by movement of said operating member.

32. An apparatus according to claim 28, wherein said adjustment means further comprises a biasing means urging said lever into said first position.

33. An apparatus according to claim 15, wherein said carriage includes a headrest and a support on which the headrest is pivoted, there being provided adjustment means enabling said headrest to be adjusted forwardly and rearwardly of said carriage, said adjustment means including an adjustment member which can be moved up and down relative to said support, and at least one cranked element connected between said adjustment member and said headrest.

34. An apparatus according to claim 33, wherein said adjustment member is one of a pair of members which are movable up and down relative to said support, and said adjustment means further comprises locking means operable selectively to lock and release said members relative to said support, said locking means being operated by movement of said members towards and away from each other.

35. An apparatus according to claim 34, wherein said members are of inverted U-shaped configuration and have a pair of limbs, said members are nested one within the other, and said support includes a pair of hollow uprights in which said limbs of said members are slidably received.

36. An apparatus according to claim 35, wherein said locking means include jamming roller mechanisms which are carried by said limbs of said members and which cooperate with said uprights selectively to lock and release said members relative to said support.

37. An apparatus according to claim 34, wherein said carriage also includes a sub-frame on which said support is mounted for up-and-down movement relative thereto, said members are released for movement relative to said support by upward movement of one of said members relative to the other of said members, and said one of said members abuts against said sub-frame when said support is moved to a lowermost position relative to said sub-frame.

38. An apparatus according to claim 15, wherein the operating means include two manually graspable levers provided on opposite sides of said carriage so that said levers may be grasped by left and right hands of the wheelchair occupant, respectively, each lever being movable in first and second mutually opposite directions from a neutral position, movement of a lever from said neutral position in said first direction being operative to cause said carriage to be raised relative to said frame, and movement of said lever in said second direction being operative to cause said carriage to be lowered relative to said frame.

39. An apparatus according to claim 38, further comprising means to operate the levers in unison, including a torque tube for linking the levers together.

40. An apparatus according to claim 38, wherein movement of said at least one lever from said neutral position through a fixed stroke in said first direction is operative to cause said carriage to be raised relative to said frame by a predetermined increment, and holding means is provided to hold said carriage in its raised position while said at least one lever is returned to said neutral position.

41. An apparatus according to claim 40, wherein said at least one lever has associated therewith a ratchet mechanism, said ratchet mechanism being connected between said carriage and said frame and being disengaged by movement of said at least one lever in said second direction, and said holding means is constituted by a separate holding device operative to prevent said carriage from being lowered relative to said frame while said ratchet mechanism is disengaged.

42. An apparatus according to claim 38, wherein said operating means also includes a device operable selectively in a first mode to prevent said carriage from being lowered relative to said frame and in a second mode to permit said carriage to be lowered relative to said frame at a controlled rate, said device being placed in said second mode of operation by movement of said at least one lever from said neutral position in said second direction.

43. An apparatus according to claim 42, further comprising a foot-operated pedal provided on said frame and operable additionally to place said device in said second mode of operation.

44. An apparatus according to claim 43, wherein said device includes an actuator by means of which said device is placed selectively in said first and second modes of operation, said actuator being operatively engaged by said foot-operated pedal, and wherein a linkage operatively interconnects said at least one lever and said pedal, whereby movement of said at least one lever from said neutral position in said second direction causes said pedal to be operated.

45. An apparatus according to claim 44, wherein said linkage includes a flexible cable connected at one end thereof to said at least one lever, an opposite end of said cable being connected to a member which is pivoted to said frame and which bears against said pedal.

46. The apparatus according to claim 42, wherein said device is composed of a fluid damper which is compressed and extended as said carriage is turned relative to said frame.

* * * * *